US011761202B2

(12) United States Patent
De Faveri

(10) Patent No.: US 11,761,202 B2
(45) Date of Patent: Sep. 19, 2023

(54) METHOD FOR OBTAINING A VERTICAL OR HORIZONTAL PROFILED ELEMENT FOR THE INTERCONNECTION OF PLASTERBOARD PANELS TO WALLS AND ELEMENT OBTAINED WITH SUCH METHOD

(71) Applicant: ECLISSE S.R.L., Pieve di Soligo (IT)

(72) Inventor: Luigi De Faveri, Refrontolo (IT)

(73) Assignee: ECLISSE S.R.L., Pieve di Soligo (IT)

( * ) Notice: Subject to any disclaimer, the term of this patent is extended or adjusted under 35 U.S.C. 154(b) by 127 days.

(21) Appl. No.: 17/388,104

(22) Filed: Jul. 29, 2021

(65) Prior Publication Data

US 2021/0355678 A1 Nov. 18, 2021

Related U.S. Application Data

(62) Division of application No. 17/042,601, filed as application No. PCT/EP2018/071405 on Aug. 7, 2018, now Pat. No. 11,499,309.

(30) Foreign Application Priority Data

Mar. 29, 2018 (IT) ..... 102018000004060

(51) Int. Cl.
*E04B 2/74* (2006.01)
*E04B 2/78* (2006.01)
(Continued)

(52) U.S. Cl.
CPC ..... *E04B 2/7457* (2013.01); *B21H 8/005* (2013.01); *E04B 2/789* (2013.01); *E04F 13/0803* (2013.01); *E04B 2002/7477* (2013.01)

(58) Field of Classification Search
CPC ..... Y10T 29/49629
See application file for complete search history.

(56) References Cited

U.S. PATENT DOCUMENTS 600,392 A 3/1898 Whitenack
2,706,315 A 4/1955 Price
(Continued)

FOREIGN PATENT DOCUMENTS

EP 2 299 043 A1 3/2011
IT 0000278468 6/2014
RU 2 463 411 C1 10/2012

OTHER PUBLICATIONS

International Search Report and Written Opinion dated Dec. 14, 2018 received in International Application No. PCT/EP2018/071405.

(Continued)

*Primary Examiner* — Jason L Vaughan
(74) *Attorney, Agent, or Firm* — Scully, Scott, Murphy & Presser, P.C.

(57) ABSTRACT

A method for obtaining a vertical or horizontal profiled element for the interconnection of plasterboard panels to walls, in particular to plasterboard walls that can be applied to in-wall frames for retractable sliding doors or for the provision of drywall dividing walls.
The method entails a continuous machining of a metallic lamina by punching or drawing or rolling obtained by using two rollers, one acting as a die and the other acting as a punch, so as to obtain on the metallic lamina a plurality of holes, which are uniformly distributed according to a series of mutually parallel rows.

2 Claims, 8 Drawing Sheets

(51) Int. Cl.
*E04F 13/08* (2006.01)
*B21H 8/00* (2006.01)

(56) References Cited

U.S. PATENT DOCUMENTS

| | | | | |
|---|---|---|---|---|
| 3,243,930 | A | 4/1966 | Slowinski et al. | |
| 4,142,663 | A * | 3/1979 | Blatnik | B21C 37/157 228/147 |
| 4,408,427 | A | 10/1983 | Zilch | |
| 5,620,290 | A | 4/1997 | Homfeldt et al. | |
| 8,028,495 | B2 | 10/2011 | Knauf | |
| 9,010,070 | B2 | 4/2015 | Darr, III et al. | |
| 9,234,348 | B1 * | 1/2016 | Lehane | E04B 9/18 |
| 2009/0013633 | A1 | 1/2009 | Aubuchon | |
| 2009/0090081 | A1 | 4/2009 | Knauf | |
| 2009/0223167 | A1 | 9/2009 | Anderson | |
| 2021/0095465 | A1 | 4/2021 | De Faveri | |

OTHER PUBLICATIONS

Italian Search Report and Written Opinion dated Dec. 6, 2018 received in Italian Application No. IT 201800004060, with partial English-language translation.
English-language translation of Russian Office Action dated Oct. 11, 2021 received in Russian Patent Application No. 2020135312/03(065033).
U.S. Final Office Action dated Mar. 21, 2022 received in U.S. Appl. No. 17/042,601.

* cited by examiner

METHOD FOR OBTAINING A VERTICAL OR HORIZONTAL PROFILED ELEMENT FOR THE INTERCONNECTION OF PLASTERBOARD PANELS TO WALLS AND ELEMENT OBTAINED WITH SUCH METHOD

CROSS REFERENCE TO RELATED APPLICATIONS

The present application is a divisional of co-pending application having U.S. Ser. No. 17/042,601, filed on Sep. 28, 2020, which is a 371 of International application having Serial No. PCT/EP2018/071405, filed on Aug. 7, 2018, which claims priority to Application IT 102018000004060 filed on Mar. 29, 2018, the contents of all of which are incorporated herein by reference.

The present application relates to a method for obtaining a vertical or horizontal profiled element for the interconnection of plasterboard panels to walls, in particular to plasterboard walls that can be applied to in-wall frames for retractable sliding doors or for the provision of drywall dividing walls, and to the element obtained with such method.

Nowadays it is known to provide door frames which involve the use of an in-wall frame, positioned inside a wall, in which a door or a panel is slideably associated and which is also known as a "retractable door".

This solution allows to reduce the space occupation of the door in a room by virtue of the possibility to make it slide into the in-wall frame: it is thus possible to use the space adjacent to the door, which would instead be occupied by doors of the type hinged laterally to a frame.

In the known art, the in-wall frame embedded in the wall is usually constituted by a frame that comprises a plurality of horizontal and vertical profiled elements, a pair of front posts, an abutment post and a rear post, all connected by horizontal crossmembers made of metal plate, preferably aluminum, the whole defining a containment case of the panel or of the door.

The components of the in-wall frame are usually provided by way of machining operations that substantially involve the folding of a metallic lamina.

Above the casing there protrudes, along an axis which is longitudinal to the casing and is extended on the opposite side with respect to the containment casing, a rail which is concealed by a profiled element that is commonly called an "upper crossmember" or "pocket header" or also "fanlight".

Trolleys are associated slideably within the track and are coupled to the upper edge of the door or panel in order to allow the sliding thereof in and out of the in-wall frame.

Usually the abutment post that acts as a terminal for the abutment of the front edge of the door or panel is associated with the end of the rail that is not associated with the vertical posts.

Such conventional door frames thus use metallic profiled elements that can be mounted together and are sold for example in kit form for assembly.

To this end this same applicant is owner of Italian utility model no. 278468 which discloses a framework for walls or panels made of plasterboard which is constituted by a first element which is adapted to act as an upper crossmember for the front and rear upright members and also by a rail/guide for sliding trolleys for supporting a door, said framework being furthermore constituted by brackets for centering an upper framework and for supporting the walls or panels made of plasterboard.

Although this solution is valid, it exhibits a drawback in that, in general, in such solutions, which are also known as in-wall frames for drywall buildings, the external finish of the wall is obtained by superimposing plasterboard panels on the structure which are then affixed by way of using conventional affixing systems such as screws, both self-tapping and non-self-tapping.

Such method entails the necessity of having to make holes in the metal plate that constitutes the horizontal crossmembers arranged to support the plasterboard panels, such metal plate having a smooth perforation base.

Therefore a certain pressure has to be exerted, which entails an initial bending of the profiled element, which increases with the increase of the thrust that the installation technician has to exert using the screw gun, thus making perforation of the metal difficult.

It should be noted moreover that the plasterboard panels are basically panels adapted to fill in the metallic structures or frames, both on one side and on the other, and they are provided by way of a mixture of plaster or the like that is compressed so as to reach a determined thickness and is inserted in a sandwich-like manner between two layers of cellulose material, commonly paper.

Such paper covering to all intents and purposes forms a skin and stratifies the layer of plaster, the result obtained is a panel that is commonly called "plasterboard panel".

The layer of plaster ensures thickness and insulation, but on its own it would break easily, and when screwing it to the structure it would crumble at the fastening point. The compactness of the panel is ensured by the two coverings in paper, and the hold at the fastening point is given by the fastening of the head of the screw, which compresses the skin or layer of paper onto the underlying plaster. It is therefore necessary, for an optimal and secure fastening, that the thin paper layer does not break.

In order to overcome the mentioned drawbacks, some makers provide structures in which profiled elements are used with reduced thicknesses in order to be perforated more easily; this however entails a weakening of the profiled element, on which adapted ribbing has to be provided in order to stiffen it.

The result that is obtained, although functional, is however a compromise between rigidity/bending and thickness, and in any case it entails a complexity of construction in the profiled element and a higher implementation cost for it.

Other makers provide systems in which horizontal crossmembers are used to support and fasten the plasterboard panels, and these crossmembers are made of wood instead of metal.

Such solutions can help in the fastening operation, in that wood can be perforated easier than metal; however, wooden crossmembers are more flexible than metallic solutions as it is not possible to produce them with greater thicknesses than the latter, in order to ensure that the entire structure can be accommodated in the cross-section/thickness of the wall and at the same time is able to arrange the sliding door or panel inside it.

Another drawback that can be found in the prior art is constituted by the fact that the consistency of plasterboard panels has not a high-density and therefore makes such material friable, while instead the underlying metallic horizontal crossmembers have a high surface hardness and have a smooth perforation base on which the plasterboard panels lay.

It can therefore happen that the tip of the fastening screw subjected to pressure during screwing can laterally slide, thus being screwed not perpendicular to the crossmember, with the consequence that it has to be screwed in deeper in order to ensure that the head of the screw is co-planar with the surface of the facade outside the wall; this brings the risk that the tip of the screw might protrude too far inside the in-wall frame and damage the door or panel when it slides and is accommodated inside the compartment.

Systems are known in which horizontal crossmembers are used, in which the resting surface of the panels is embossed so as to create, by way of a calendering operation, an incision of a desired pattern: this solution only allows to try to prevent the tip of the screw from sliding beyond a certain measurement determined by the pattern obtained, but it does not prevent the screw from sliding and it therefore does not solve the problem mentioned earlier, while contributing to increasing the structural complexity of the profiled element and the corresponding implementation costs.

The aim of the present invention is therefore to solve the above mentioned technical problems, eliminating the drawbacks in the cited prior art and hence providing a method for obtaining a profiled element that allows to achieve the optimal and rapid support/placement and/or the fastening of plasterboard panels adapted to define the sides of an in-wall frame for doors or panels that slide in-wall, and which can be installed in frames for providing plasterboard walls.

Within this aim, an object of the invention is to provide a profiled element that offers a considerable simplicity of construction and installation and which at the same time allows to obtain the fastening of normal plasterboard panels stably, durably and quickly.

Another object of the present invention is to obtain a profiled element whose correct coupling to the panel is obtained irrespective of the ability of the installation technician, who has only to screw the screws in any position of the profiled element without exerting particular pressure.

Another object is to provide a usable profiled element to which to fasten plasterboard walls, which has an optimal functionality and strength and which moreover allows to have a particularly reduced thicknesses.

Another object is to provide a profiled element that enables a facilitated fastening thereto of plasterboard panels even by people with no special training and with conventional or standard means for screwing that are easy available.

Another object is to provide a profiled element that allows to apply plasterboard panels thereto while safeguarding their structural integrity.

Another object is to provide an invention that is structurally simple, which can be provided with conventional systems and machines, and which has low cost.

This aim and these and other objects which will become better apparent hereinafter are achieved by a method for obtaining a vertical or horizontal profiled element 1 for the interconnection of plasterboard panels 2 to walls 10, characterized in that it provides for a continuous machining of a metallic lamina by punching or drawing or rolling obtained by using two rollers, one acting as a die and the other acting as a punch, so as to obtain on said metallic lamina a plurality of holes 13, which are uniformly distributed according to a series of mutually parallel rows, in said method the side or diameter D1 and the center distance D2 between two of said holes 13 that are mutually closer and the thickness S of said planar surface 12 being defined by the following proportions: $D2 \geq S$, $0.4 \leq S \leq 1.5$ and $D1 \leq 3S$.

Further characteristics and advantages of the invention will become better apparent from the detailed description of a particular but not exclusive embodiment, illustrated by way of non-limiting example in the accompanying drawings, wherein.

Figure 1:
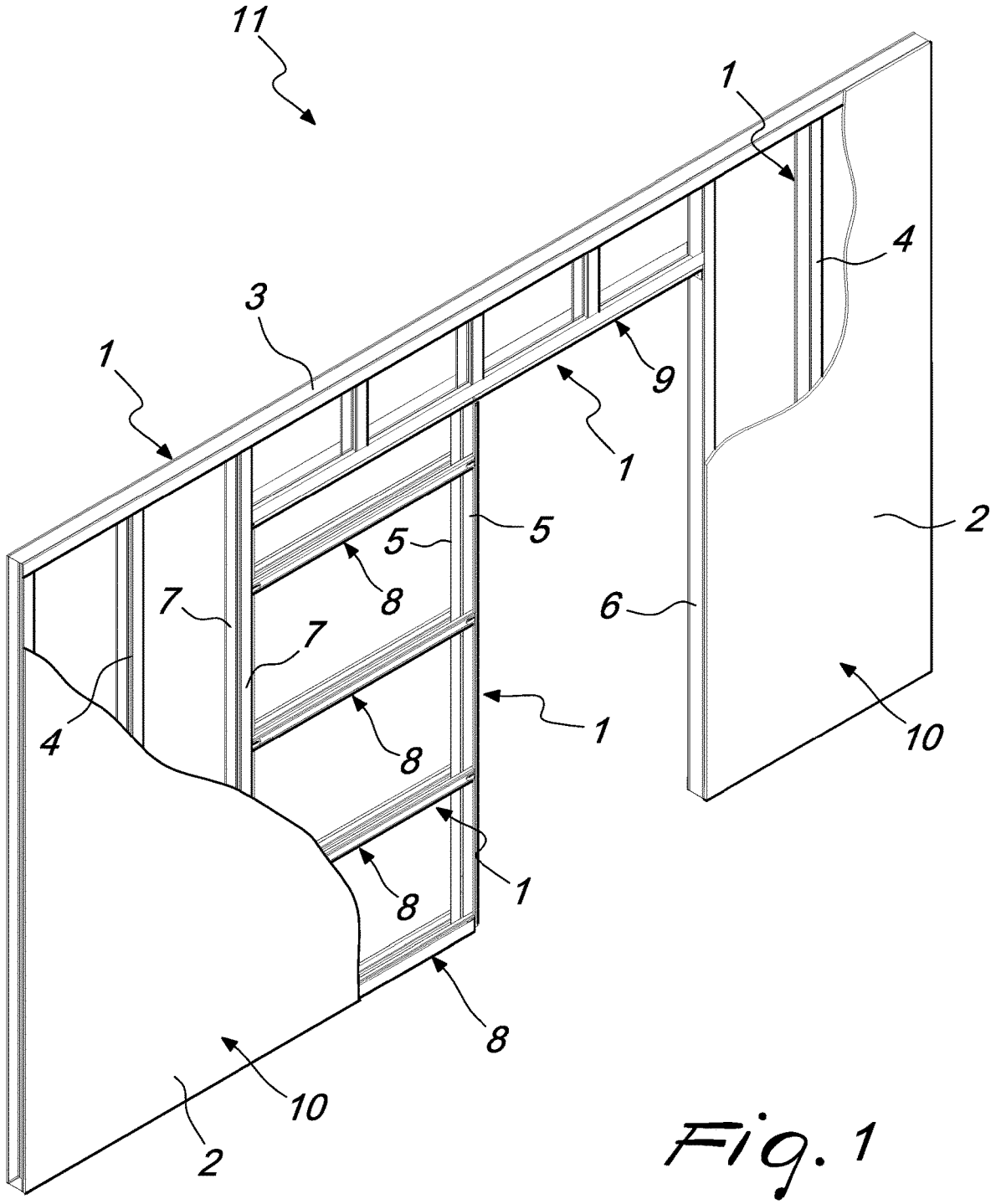
FIG. 1 is a partially cross-sectional perspective view of an in-wall frame for doors or panels.
Figure 3:
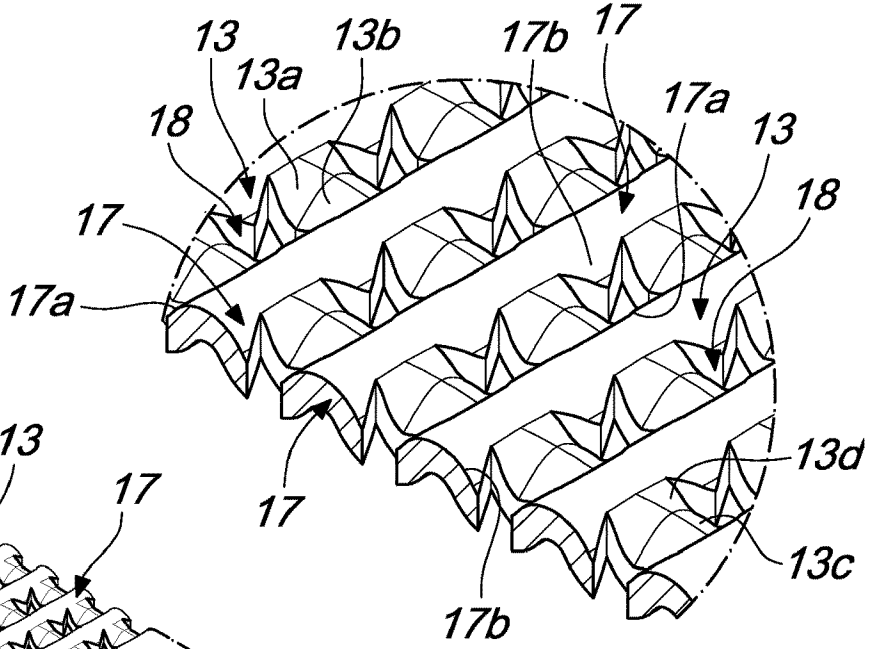
FIG. 3 is a detail showing the holes provided on the profiled element.
Figure 2:
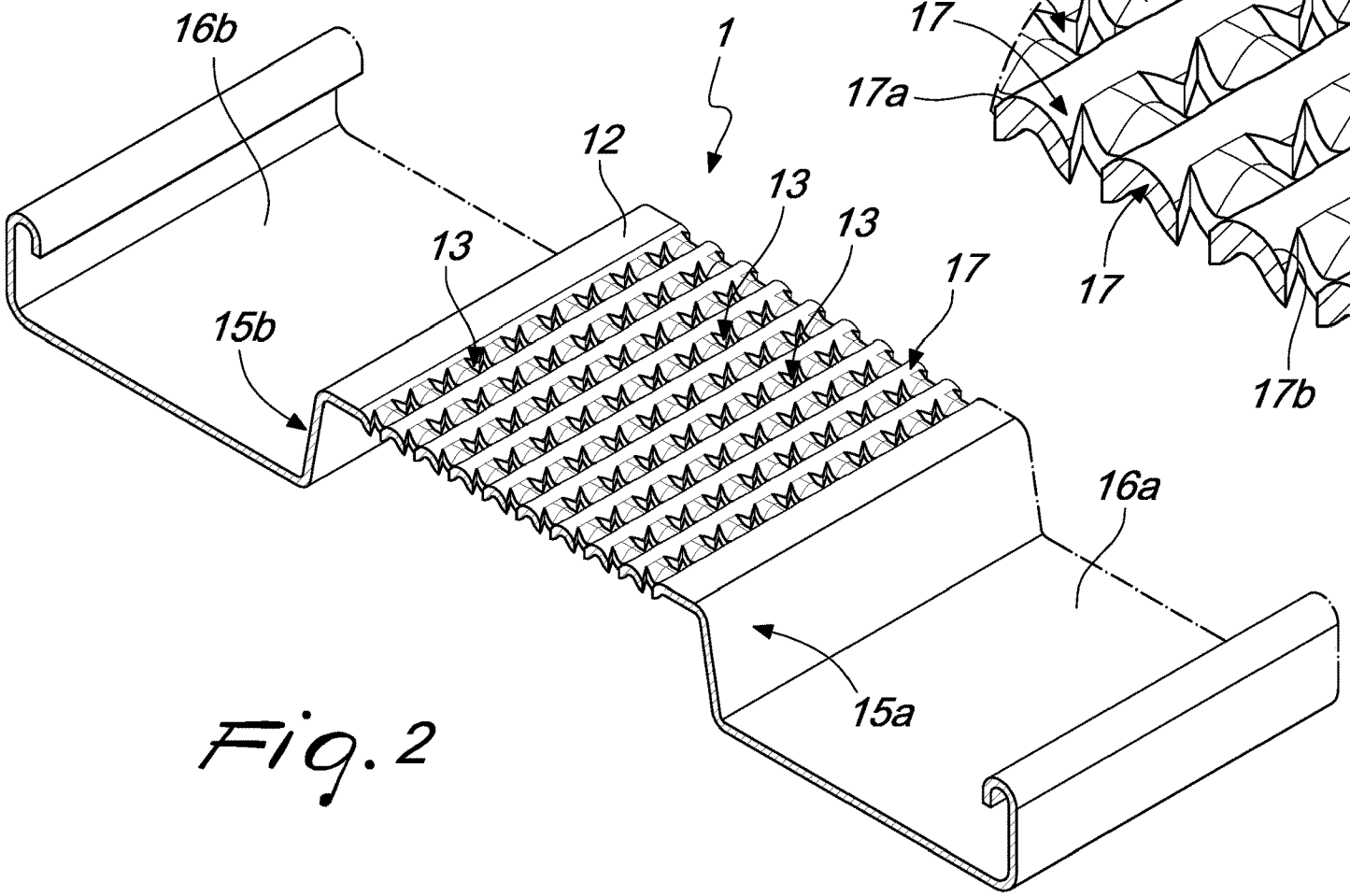
FIG. 2 is a perspective view from above of a horizontal crossmember.
Figure 5:
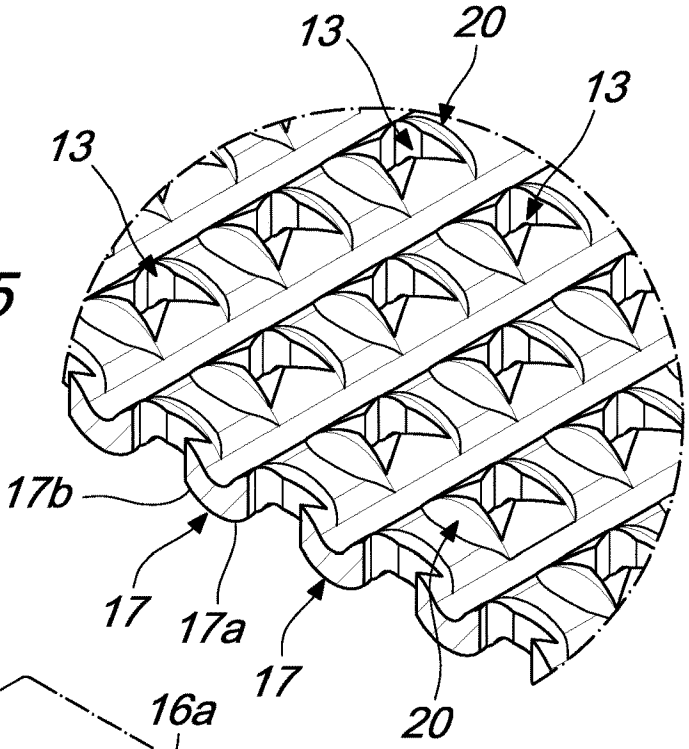
FIG. 5 is a detail showing the holes provided on the profiled element, in the previous figure.
Figure 4:
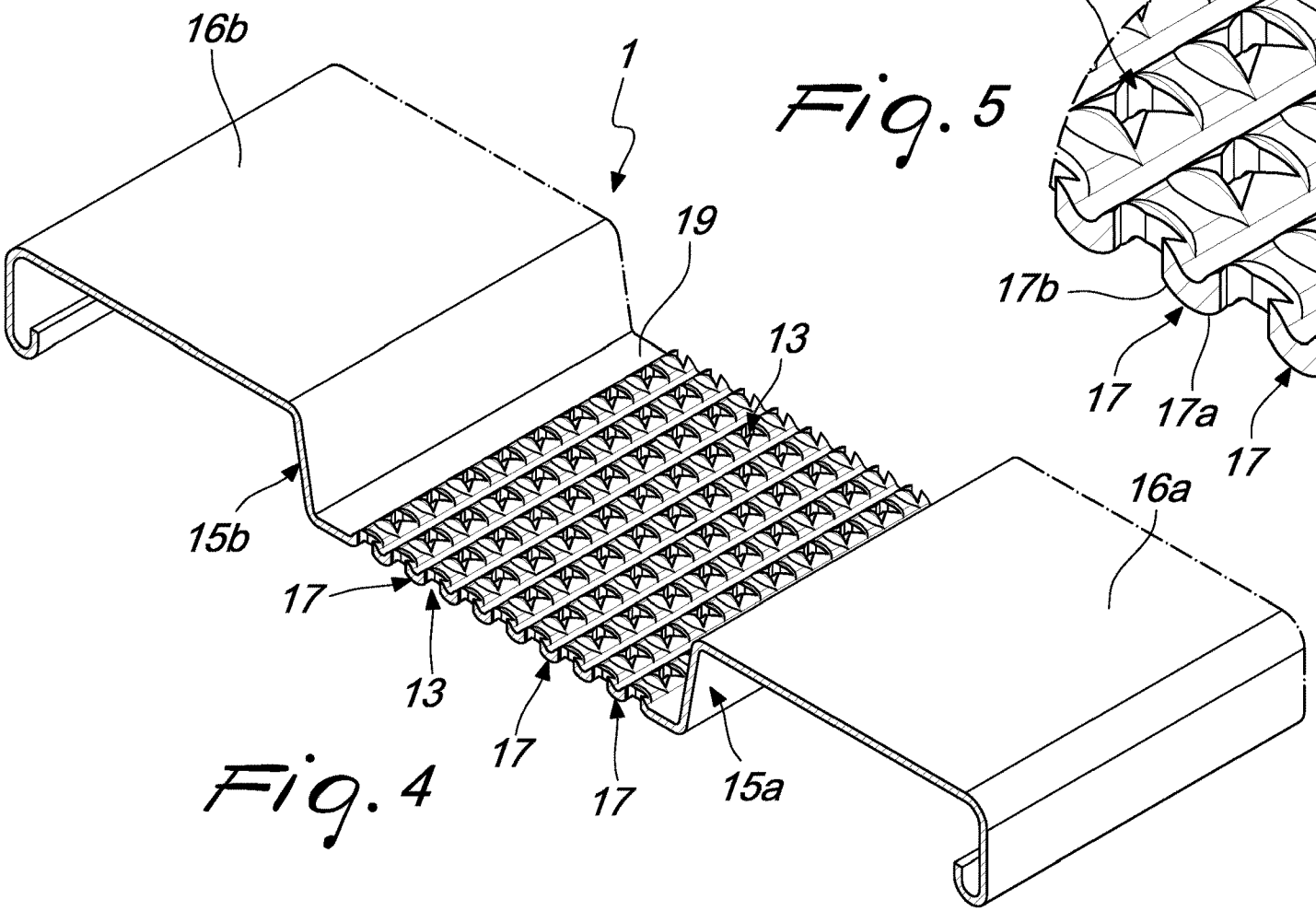
FIG. 4 is a perspective view from below of a horizontal crossmember.
Figure 6:
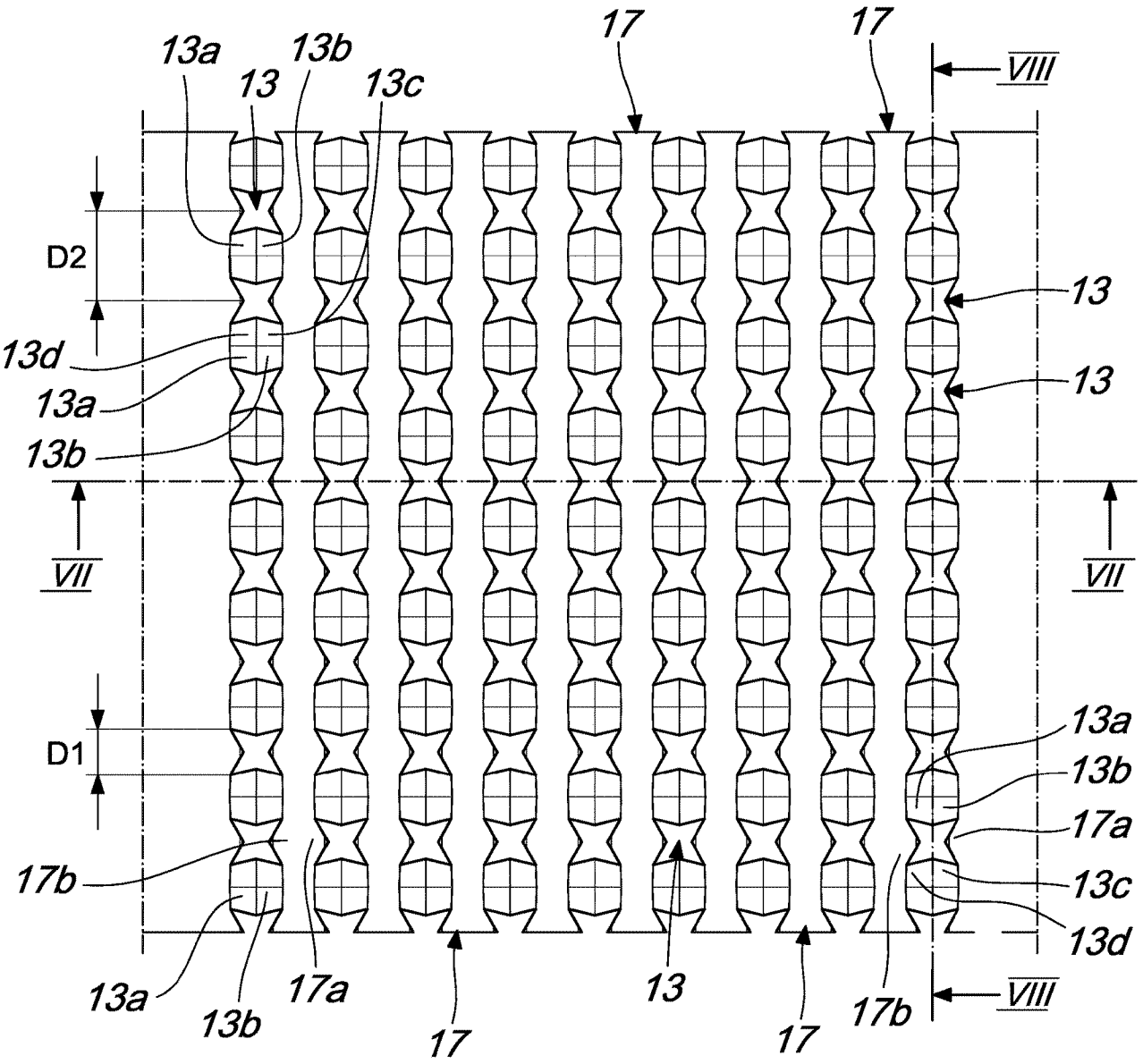
FIG. 6 is a plan view of a part of the horizontal crossmember in the region with the holes.
Figure 7:
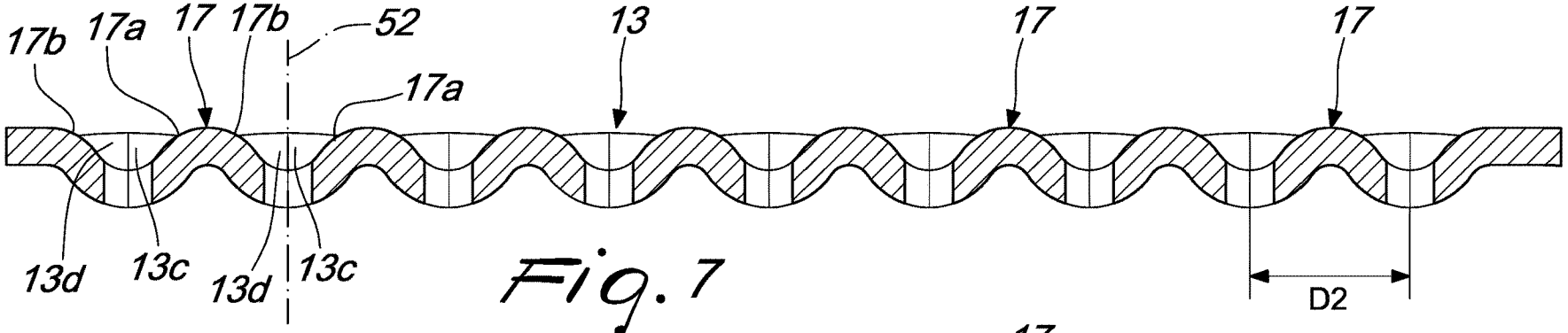
FIG. 7 is a sectional view along the line VII-VII in FIG. 6.
Figure 8:
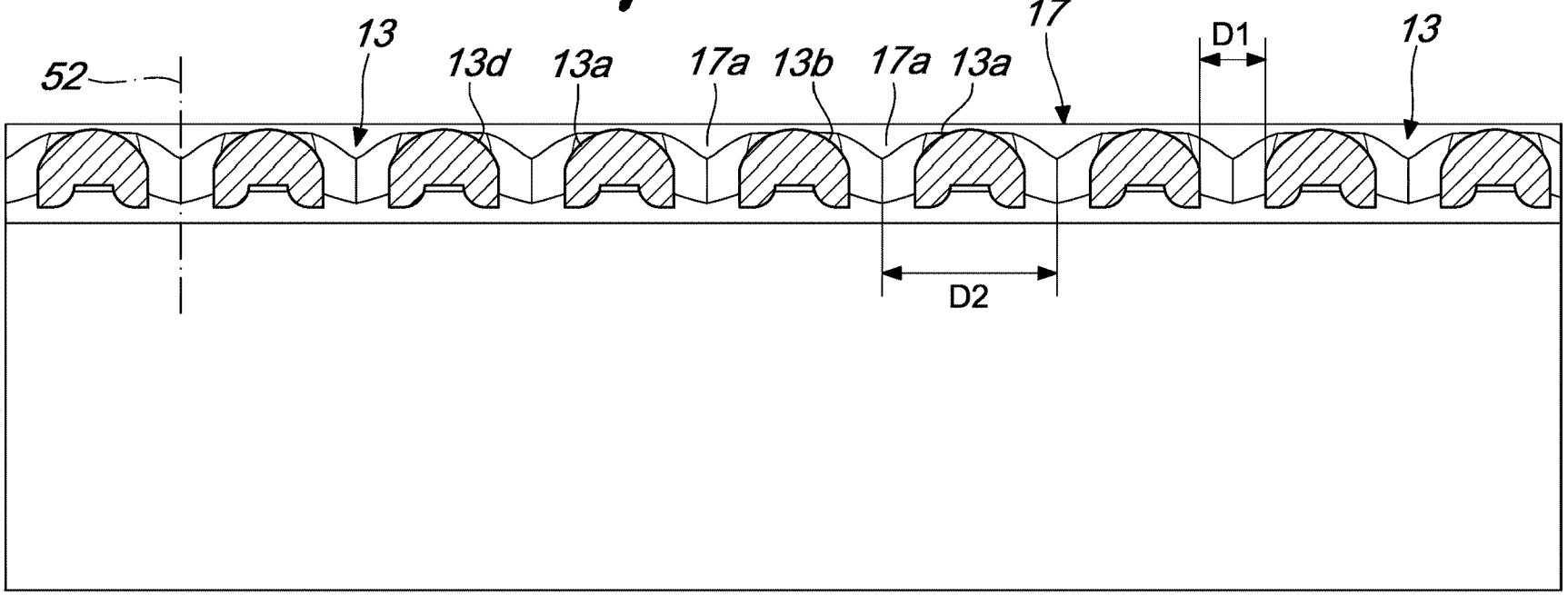
FIG. 8 is a cross-sectional view taken along the line VIII-VIII in FIG. 6.
Figure 9:
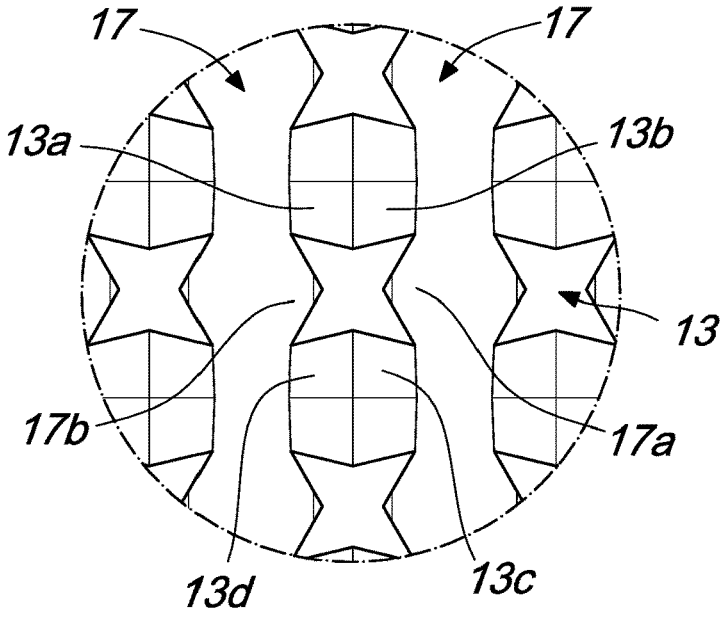
FIG. 9 is a detail showing the holes in a plan view.
Figure 10:
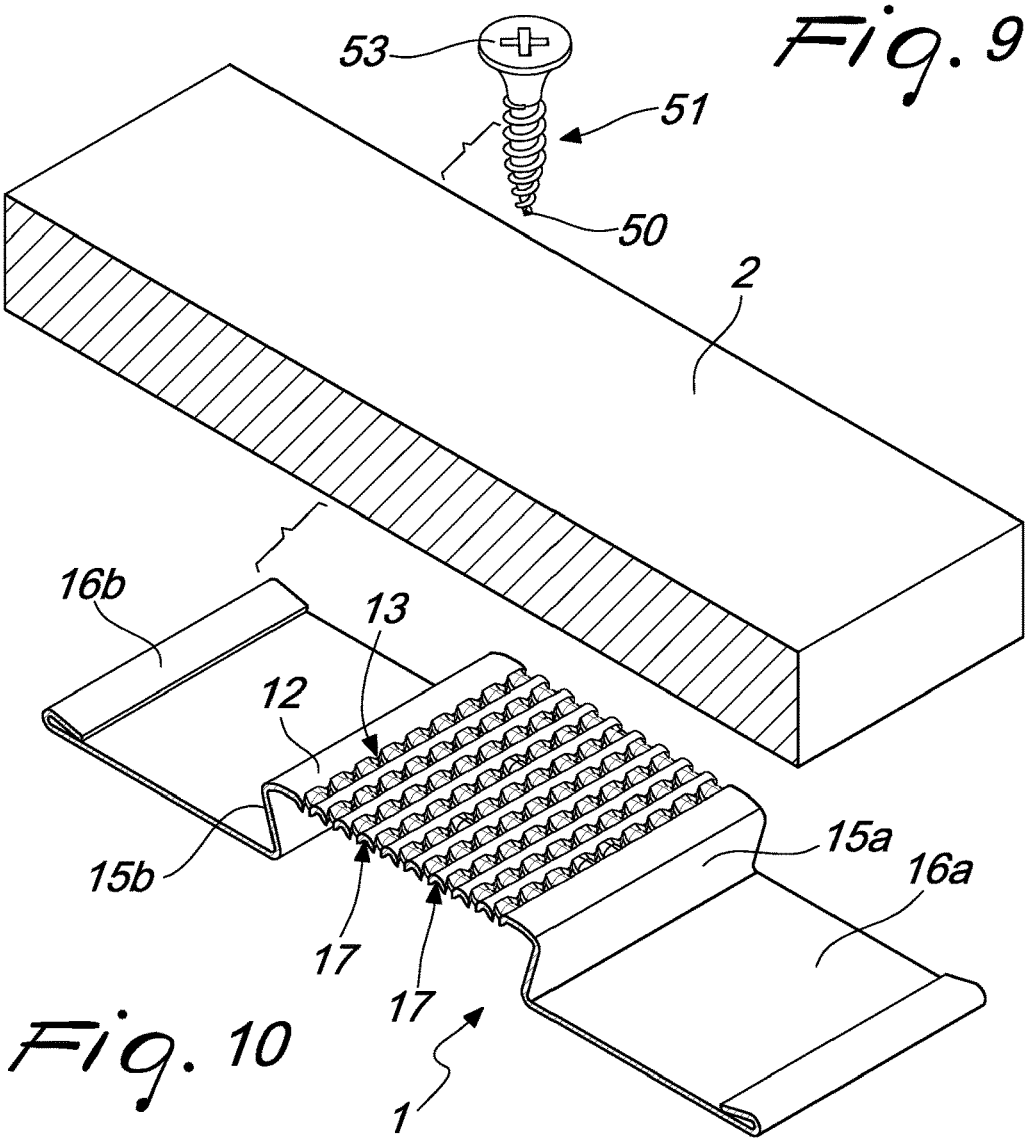
FIG. 10 is an exploded view of a profiled element, a panel, and a screw.

In the exemplary embodiments that follow, individual characteristics, given in relation to specific examples, may actually be interchanged with other different characteristics that exist in other exemplary embodiments.

With reference to the figures, the reference numeral 1 generally designates a profiled element with which plasterboard walls or panels 2 can be associated.

The profiled element 1 can be constituted by one or more horizontal 3 or vertical 4 profiled elements, by one or more front posts 5, by one or more abutment posts 6, by one or more rear posts 7, by one or more horizontal crossmembers 8, by one or more upper crossmembers 9 for the rear posts 7, front posts 5 and abutment posts 6 and also by a support for a rail/guide (not shown) for sliding trolleys (not shown) with which sliding doors or leaves (not shown) are associated, all made of metal plate.

In the specific embodiment, the use is shown of a profiled element 1 in its various forms used to achieve the support/placement and/or the fastening of plasterboard panels 2 adapted to define the walls 10 of an in-wall frame 11 for doors or panels which can slide in-wall or which can be installed in frames for providing plasterboard walls.

In the specific embodiment shown, the upper crossmember 9 furthermore connects the abutment post 6 which is fixed to the opposite end from the rear post 7, and the front posts 5 are arranged approximately at the same distance between the rear posts 7 and the front posts 5.

The rear posts 7 and the front posts 5 are transversely connected by the horizontal crossmembers 8 and are positioned at a vertical distance from each other such as to divide the length of the rear post 7 and front posts 5 into approximately identical parts.

The method allows to obtain, starting from a metallic lamina, a profiled element 1 that has, in each one of its embodiments, the horizontal 3 or vertical 4 profiled element, the front post 5, the abutment post 6, the rear post 7, the horizontal crossmember 8, the upper crossmember 9, a planar surface 12 on which a plurality of holes 13 is provided, which are uniformly distributed according to a series of mutually parallel rows.

The holes 13, which are through holes, can be obtained by way of a step of perforating the planar surface 12, which is obtained by way of punching or even by drawing, for example by way of a continuous machining which can be obtained by way of rolling and therefore using two rollers, one acting as a die (which determines the shape and the perforation of the metallic lamina so as to obtain the various holes 13), and the other acting as a punch (which determines the external shape of each one of the holes 13).

In the specific embodiment shown the method also allows to obtain, for each horizontal crossmember 8 and at the longitudinal sides of the planar surface 12, one or more ridges or, as illustrated, two side edges or folds 15*a*, 15*b* and two wings 16*a*, 16*b* which give the horizontal crossmember 8 a substantially omega-like shape; such machining strengthens the profiled element and makes it less flexible.

As mentioned, the holes 13, which are obtained by deforming the planar surface 12, are distributed uniformly according to a series of mutually parallel rows, so as to obtain, between two adjacent rows, an upper surface 17 which thus delimits each distinct row of laterally adjacent holes 13 and is substantially shaped like an upturned U which determines a surface that is inclined in the direction of the adjacent holes 13 that are arranged at its sides.

Each one of the holes 13 has, in plan view, a substantially conical shape 18 which provides a guide for the needle-like tip 50 of a fastening screw 51 to move toward the axis 52 of the corresponding hole 13 if the tip is arranged either on the upper surface 17 or at the side walls or surfaces (indicated in clockwise order) 13*a*, 13*b*, 17*a*, 13*c*, 13*d* and 17*b* of each hole 13 and of the upper surface 17.

A perforated conical tab 20 protrudes, at each hole 13, at the lower surface 19 which is opposite the upper surface 17 and produces a localized increase in the thickness S of the planar surface 12.

In a plan view the holes 13 have, considering both the upper surface 17 and the lower surface 19, a substantially X-like shape.

The side or diameter D1 of each one of the holes 13 that are present on the planar surface 12 of the profiled element 1, and therefore of each one of the horizontal profiled element 3, the vertical profiled element 4, the front post 5, the abutment post 6, the rear post 7, the horizontal crossmember 8, the upper crossmember 9, is equal to or smaller than three times the measure of the thickness S of the planar surface 12 that constitutes the profiled element 1 [D1≤3S].

The center distance D2 between two of the holes 13 that are mutually closer is equal to or greater than the thickness S of the profiled element 1 [D2≥S].

The thickness S of the profiled element 1 is comprised between 0.4 and 1.5 millimeters [0.4≤S≤1.5].

The presence and the particular arrangement of the holes 13 at the planar surface 12 enables an installation technician, once a plasterboard wall or panel 2 is placed alongside a profiled element 1, whether it is a horizontal 3 or vertical 4 profiled element, a front post 5, an abutment post 6, a rear post 7, a horizontal crossmember 8, an upper crossmember 9, to fasten it by positioning the screw in any point of the plasterboard wall or panel 2, making sure that the tip of that screw will intercept one of the holes 13 and therefore allows to achieve an optimal interconnection.

Figure 11:
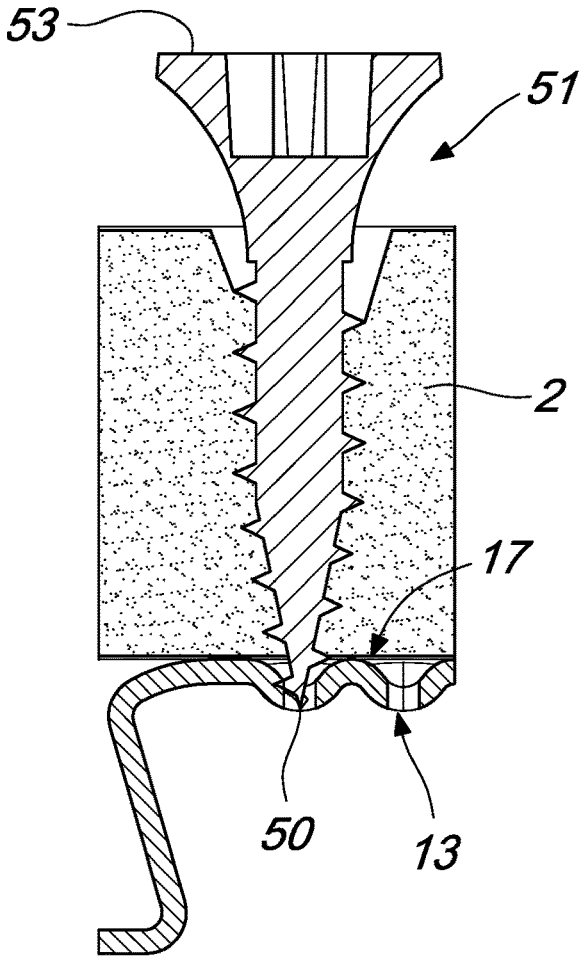
FIGS. 11 to 15 are cross-sectional views of the step of inserting a screw into a hole.
Figure 12:
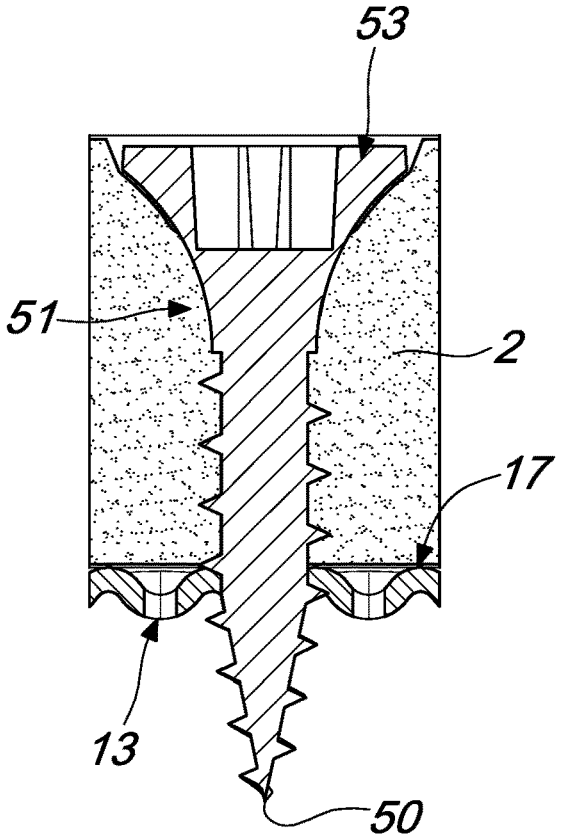

As illustrated in fact in FIGS. 11 and 12, if the tip 50 of a screw 51 is positioned at a hole 13, so as to affect one of the side walls or surfaces 13*a*, 13*b*, 17*a*, 13*c*, 13*d*, and 17*b* of the hole 13, it penetrates directly into the profiled element 1 and its head 53 compresses the skin or layer of paper onto the underlying plaster of the plasterboard panel 2 without breaking the thin paper layer.

Figure 13:
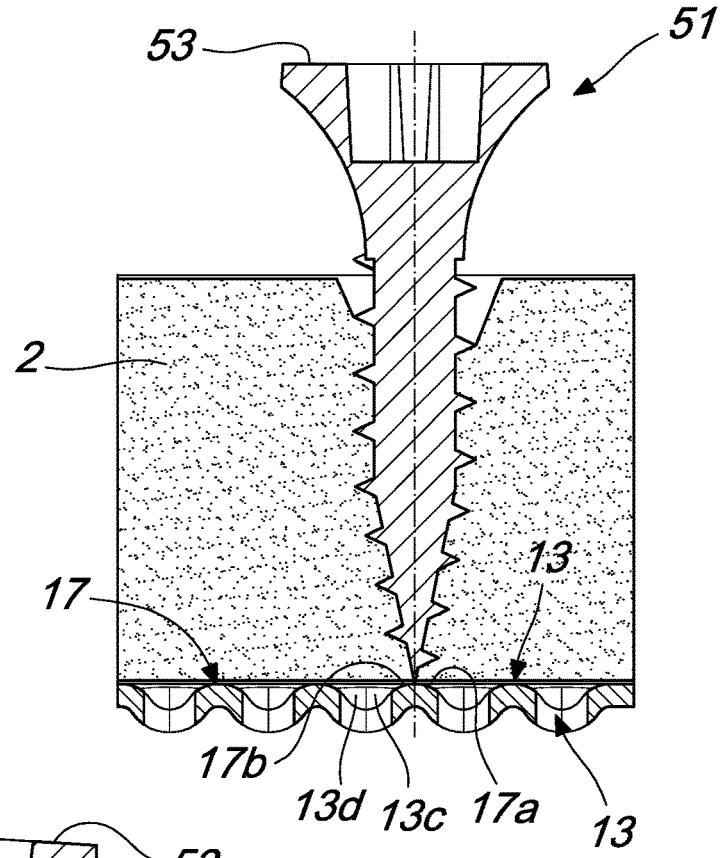
Figure 14:
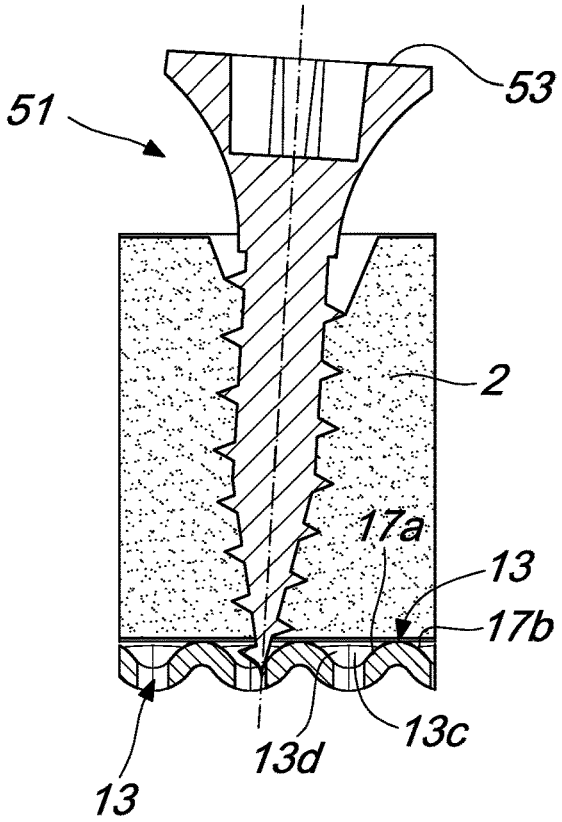
Figure 15:
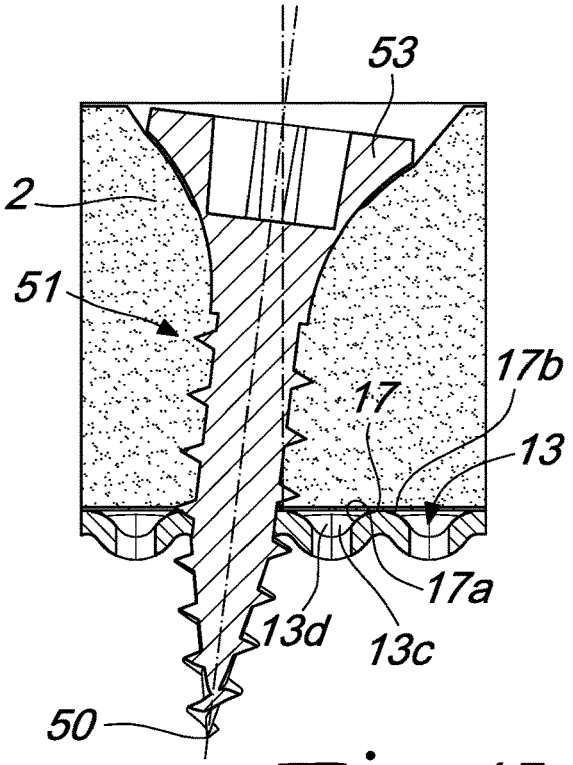

If instead, as shown in FIGS. 13 to 15, the tip 50 of the screw 51 is positioned at an intermediate point between two adjacent holes 13 and therefore at the upper surface 17 i.e. when the displacement axis of the screw toward a hole 13 is greater, a minimal degree of offset is obtained in any case and, by virtue of both the curved shape of the upper surface 17 and the shape structure of the holes 13, the tip 50 is guided toward the hole 13.

In this case too the head 53 of the screw 51, which has the characteristic trumpet shape, once screwed in, does not protrude from the surface of the panel 2 and does not break the surface layer/skin of the panel 2, thus ensuring a properly carried out fastening.

Thus it has been found that the method has achieved the set aim and objects, by allowing to obtain a profiled element that allows to achieve the optimal and rapid support/placement and/or the fastening of plasterboard panels adapted to define the sides of an in-wall frame for doors or panels that slide in-wall, and which can be installed in frames for providing plasterboard walls, such profiled element having at the same time a considerable simplicity of construction and installation and allowing to obtain the fastening of normal plasterboard panels stably, durably and quickly.

The needle-line tip 50 of the screws 51 for the plasterboard panels, in fact, once in contact with the region of the planar surface 12 that has the holes 13, finds a guiding portion whatever its initial positioning; since the needle-like tip 50 of the screw 51 never finds a planar surface, it always slides into the holes 13, which are close together so as not to shift the axis of the screw too far and this is a great screwing advantage for the installation technician.

The invention therefore resolves the problem of conveying the screw 51 to the nearest hole 13 to which its tip 50 is arranged, without such choice needing to be made by the installation technician, who has only to screw the screws 51 in any position, within the dimensions of the profiled element 1 underlying the panel that has the holes 13, without exerting particular pressure, and proceed until the head 53 of the screw 51 is flush with the surface of the panel 2; such operation is very light because high pressure is not needed to make a hole in the metal of the underlying profiled element 1.

The profiled element 1 furthermore maintains particularly reduced thicknesses and allows to fasten plasterboard walls thereto even by people with no special training and with conventional or standard means for screwing that are easily available.

The invention is of course susceptible of numerous modifications and variations, all of which are within the scope of the appended claims.

Thus it does not matter that the fastening needs to be carried out with a double plasterboard panel 2.

The materials used, as well as the dimensions that constitute the individual components of the invention, may of course be more pertinent according to the specific requirements.

The various means of achieving certain different functions certainly need not coexist only in the embodiment shown, but may be present in many embodiments, even if they are not shown. The characteristics indicated above as advantageous, convenient or the like, may also be missing or be substituted by equivalent characteristics.

The disclosures in Italian Patent Application No. 102018000004060 from which this application claims priority are incorporated herein by reference.

The invention claimed is:

1. A method for obtaining a vertical or horizontal profiled element for the interconnection of plasterboard panels to walls, wherein the method provides for a continuous machining of a metallic lamina by punching or drawing or rolling obtained by using two rollers, one acting as a die and the other acting as a punch, so as to obtain on said metallic lamina a plurality of holes, which are uniformly distributed according to a series of mutually parallel rows, a side or diameter D1 and a center distance D2 between two of said holes that are mutually closer and a thickness S of a planar surface of said metallic lamina being defined by the following proportions: $D2 \geq S$, $0.4 \leq S \leq 1.5$ and $D1 \leq 3S$.

2. The method according to claim 1, wherein the profiled element comprises one or more horizontal or vertical profiled elements, one or more front posts, one or more abutment posts, one or more rear posts, one or more horizontal crossmembers, one or more upper crossmembers for said rear posts, said front posts and said abutment posts and also a support for a track/guide for sliding trolleys with which sliding doors or leaves are associated, all made of metal plate, which is used to achieve a support/resting and/or a fixing of plasterboard panels that are adapted to define said walls of an in-wall frame for retractable sliding doors or panels or for installation in frames for the provision of plasterboard walls, said holes, being through holes that are obtained by way of a step of perforating said planar surface, which is present in said metallic lamina, obtained by said punching or drawing or rolling, which determines the shape and the perforation of said metallic lamina so as to obtain said holes, and which determines the external shape of each one of said holes.

* * * * *